US007581947B2

(12) United States Patent
Shan

(10) Patent No.: US 7,581,947 B2
(45) Date of Patent: Sep. 1, 2009

(54) CHILD RESISTANT UTILITY LIGHTER

(75) Inventor: Jian Shan, Ningbo (CN)

(73) Assignee: Xinhua Huang, Ningbo, Zhejiang Pro ( * ) Notice: Subject to any disclaimer, the term of this patent is extended or adjusted under 35 U.S.C. 154(b) by 0 days.

(21) Appl. No.: 12/078,363

(22) Filed: Mar. 31, 2008

(65) Prior Publication Data

US 2009/0004613 A1 Jan. 1, 2009

(30) Foreign Application Priority Data

Jun. 29, 2007 (CN) ..... 2007 1 0069778

(51) Int. Cl.

| | |
|---|---|
| ***F23D 11/36*** | (2006.01) |
| *F23Q 2/28* | (2006.01) |
| *F23Q 3/00* | (2006.01) |
| *F23Q 3/01* | (2006.01) |
| *F23Q 7/12* | (2006.01) |

(52) U.S. Cl. ..... 431/153; 431/255; 431/344; 431/345

(58) Field of Classification Search ..... 431/153, 431/255, 344, 345; *F23D 11/36; F23Q 2/28, F23Q 3/00, 3/01, 7/12*

See application file for complete search history.

(56) References Cited

U.S. PATENT DOCUMENTS

| | | | | |
|---|---|---|---|---|
| 3,449,637 | A * | 6/1969 | Suzuki | 361/260 |
| 3,793,561 | A * | 2/1974 | Lundh | 361/260 |
| 5,885,069 | A * | 3/1999 | Rogelet | 431/153 |
| 6,046,528 | A * | 4/2000 | LaForest et al. | 310/339 |
| 6,065,958 | A * | 5/2000 | Adams et al. | 431/153 |
| 2005/0244766 | A9 * | 11/2005 | Sung | 431/153 |

FOREIGN PATENT DOCUMENTS

| | | | |
|---|---|---|---|
| EP | 237846 | A1 * | 9/1987 |
| EP | 515693 | A1 * | 12/1992 |

* cited by examiner

*Primary Examiner*—Steven B McAllister
*Assistant Examiner*—Daniel E Namay

(57) ABSTRACT

A child resistant utility lighter having a handle, a barrel mounted in the handle and extending outward, a fuel tank within the handle and for containing liquefied gaseous fuel, a gas valve mounted on the fuel tank, a trigger being able to startup the piezoelectric unit to generate sparks for ignition, and, a lever rotatably mounted on the handle by a lever pin. The utility lighter further has a safe button slidably mounted on the handle and pushed by a first elastic element to an undepressed position; and, a piezoelectric unit contained in the handle and having a starting button, the piezoelectric unit constantly stops at a departure position in which the trigger, when pulled over, is not able to meet the piezoelectric unit, and being able to be pushed to an aligning position by depressing the safe button for ignition by pulling over the trigger.

8 Claims, 7 Drawing Sheets

CHILD RESISTANT UTILITY LIGHTER

BACKGROUND OF THE INVENTION

1. Field of the Invention

The invention relates to a child resistant utility lighter, more particularly, to a child resistant electronic gas utility lighter which is liable to be thought by a child to be out of work or out of gas, thus giving up keeping trying to ignite.

2. Description of the Prior Art

Conventional utility lighters often have a safe means or mechanism which, when locked or set to a safe mode, is able to block or increase an active force needed to pull over a trigger of the utility lighter. As to such utility lighters, a child who is not able to ignite may be interested in operating and finally find the right way to ignite. So it is thought to provide a new utility lighter a trigger thereof is able to be pulled over as conventional utility lighters without safe means but only ignited until a safe means is activated.

BRIEF SUMMARY OF THE INVENTION

The main object of the invention is to provide a child resistant utility lighter which is liable to be thought by a child to be out of work or out of gas, thus giving up keeping trying to ignite.

In order to accomplish the above object, the present invention provides a child resistant utility lighter having a handle, a barrel mounted in the handle and extending outward, a fuel tank within the handle and for containing liquefied gaseous fuel, a gas valve mounted on the fuel tank, a trigger, and, a lever rotatably mounted on the handle by a lever pin. The utility lighter further has a safe button slidably mounted on the handle and pushed by a first elastic element to an undepressed position; and, a piezoelectric unit contained in the handle and having a starting button, the piezoelectric unit constantly stays at a departure, or safe, position in which the trigger, when pulled over, is not able to meet the piezoelectric unit, and being able to be pushed to an aligning position by depressing the safe button for ignition by pulling over the trigger.

These and other objectives, features, and advantages of the present invention will become apparent from the following detailed description, the accompanying drawings, and the appended claims.

DETAILED DESCRIPTION OF THE PREFERRED EMBODIMENT

Figure 1:
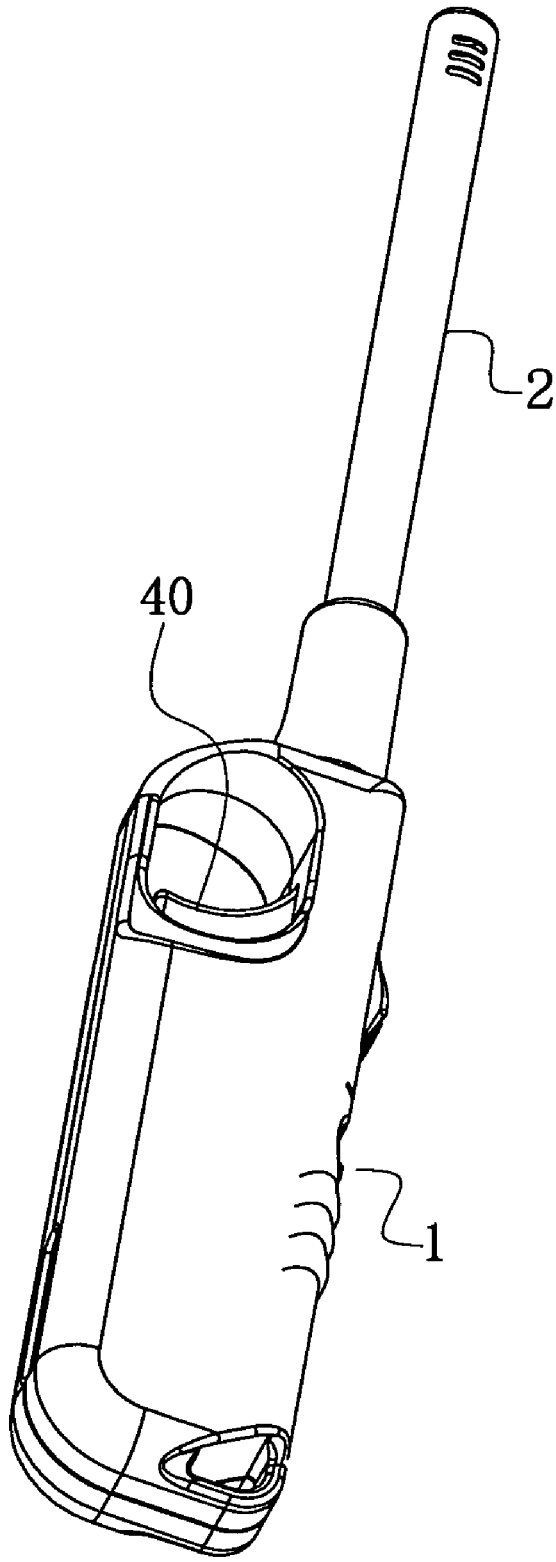
FIG. 1 is a perspective view of a preferred embodiment of the utility lighter of the invention.
Figure 2A:
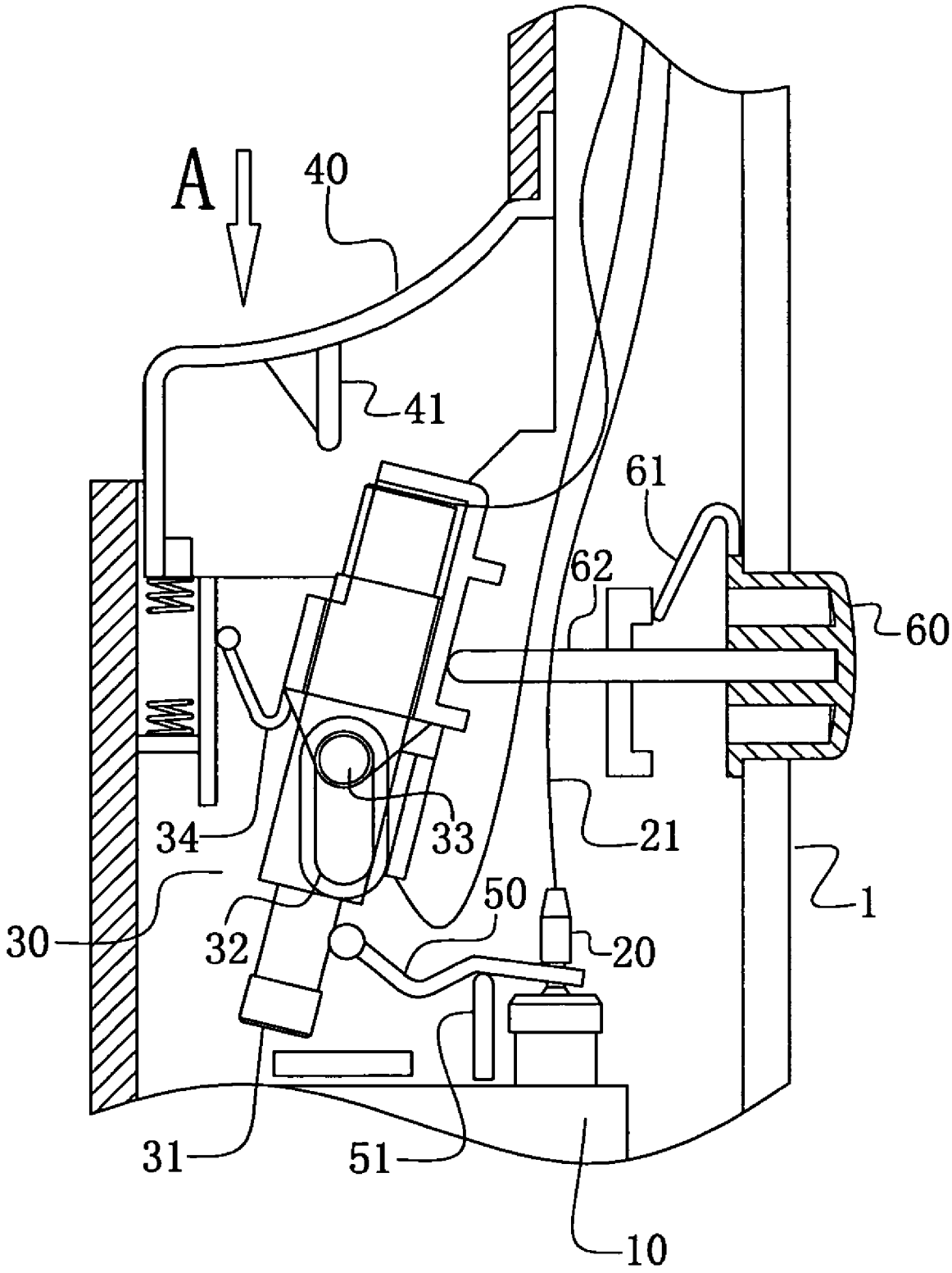
FIG. 2*a* to FIG. 2*c* are partially exploded view of the utility lighter shown in FIG. 1. And, FIG. 3*a* to FIG. 3*c* are partially exploded view of another embodiment of the utility lighter of the invention.

As shown in FIGS. 1, and 2*a*, a preferred embodiment of a child resistant utility lighter of the invention is shown. The utility lighter has a handle 1, a barrel 2 mounted in the handle 1 and extending outward, a fuel tank 10 within the handle 1 and for containing liquefied gaseous fuel, a gas valve 20 mounted on the fuel tank 10, a piezoelectric unit 30 contained in the handle 1 and has a starting button 31, a trigger 40 which when pressed downward, is able to startup the piezoelectric unit 30 to generate sparks for ignition, a lever 50 rotatably mounted on the handle 1 by a lever pin 51, and safe button 60 slidably mounted on the handle 1. The gas valve 20 is connected to a flame nozzle (not shown) contained in the barrel 2 by a fuel conveying hose 21. The gaseous fuel is able to be released from the flame nozzle and then be ignited by the sparks generated by the piezoelectric unit 30.

With reference to FIG. 2*a*, it shows a constant status of the utility lighter of the invention. The safe button 60 is pushed by a first elastic element 61 to an undepressed position. A finger 62 of the safe button 60 extends towards the piezoelectric unit 30.

The trigger 40 may has an inner protrusion 41. In the constant status, the piezoelectric unit 30 stays at a departure, or safe, position in which the inner protrusion 41 is not able to meet the piezoelectric unit 30 when the trigger 40 is pulled over along direction A. In this preferred embodiment, the piezoelectric unit 30 has a pair of opposite slits 32 respectively containing a pin 33 formed in the handle 1. The piezoelectric unit 30 is able to move along the handle 1 and rotate with respect to the pin 33. The piezoelectric unit 30 is pushed by a second elastic element 34 onto the finger 62 of the safe button 60.

Figure 2B:
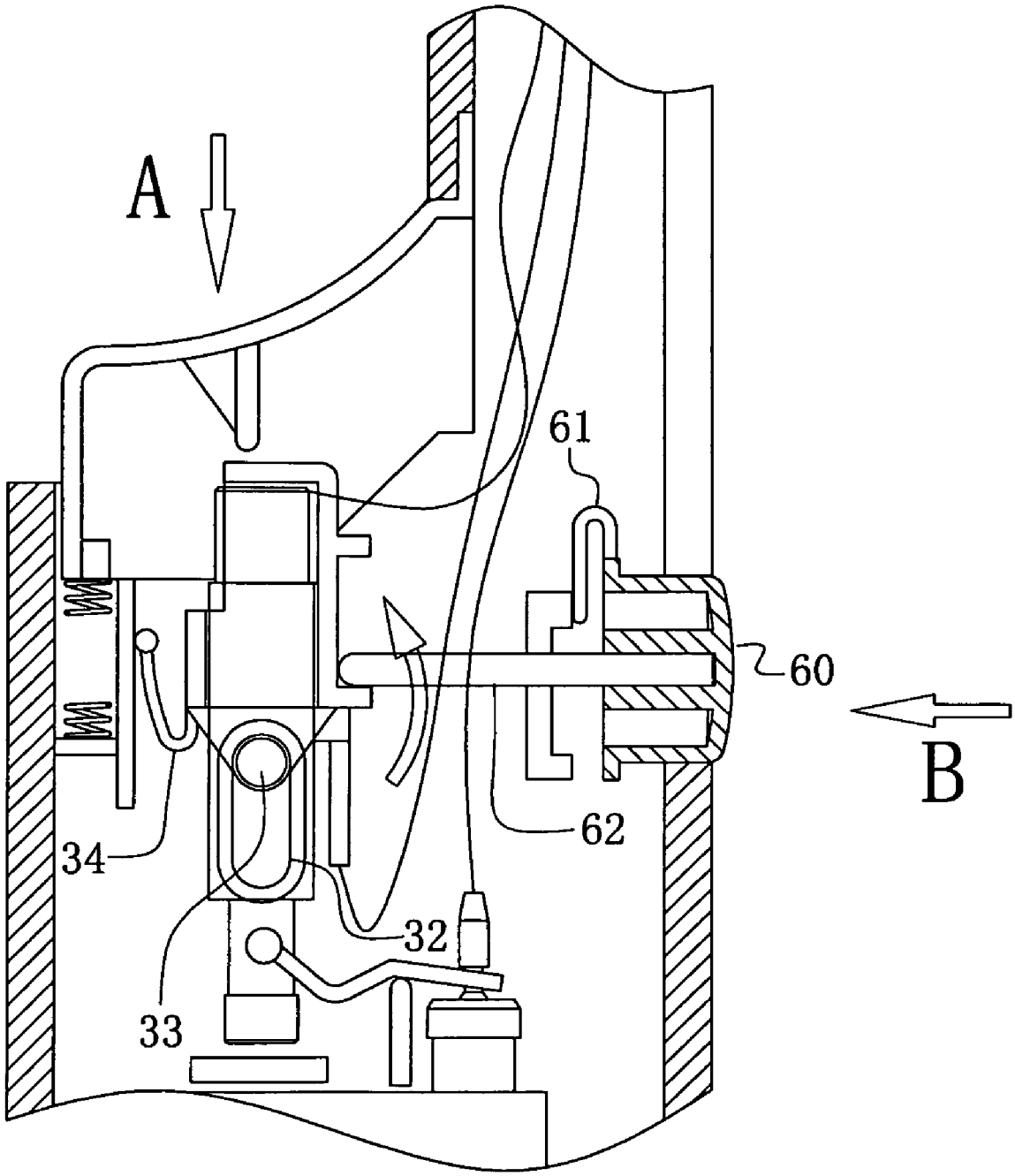

In use, when a user holds the handle 1 of the utility lighter of the invention with his hand and pull over the trigger with his forefinger, the inner protrusion 41 of the trigger 40 will not meet the piezoelectric unit 30 and the utility lighter cannot be ignited. As shown in FIG. 2*b*, if the user meanwhile depress the safe button 60 along the direction B with his thumb, the first elastic element 61 is depressed and the finger 62 moves towards the piezoelectric unit 30. Then the piezoelectric unit 30 rotates around the pin 33 and depress the second elastic element 34 to an aligning position, in which, when the safe button 60 is depressed to an utmost position, the inner protrusion 41 is able to meet the piezoelectric unit 30 when the trigger 40 is pulled over along direction A.

Figure 2C:
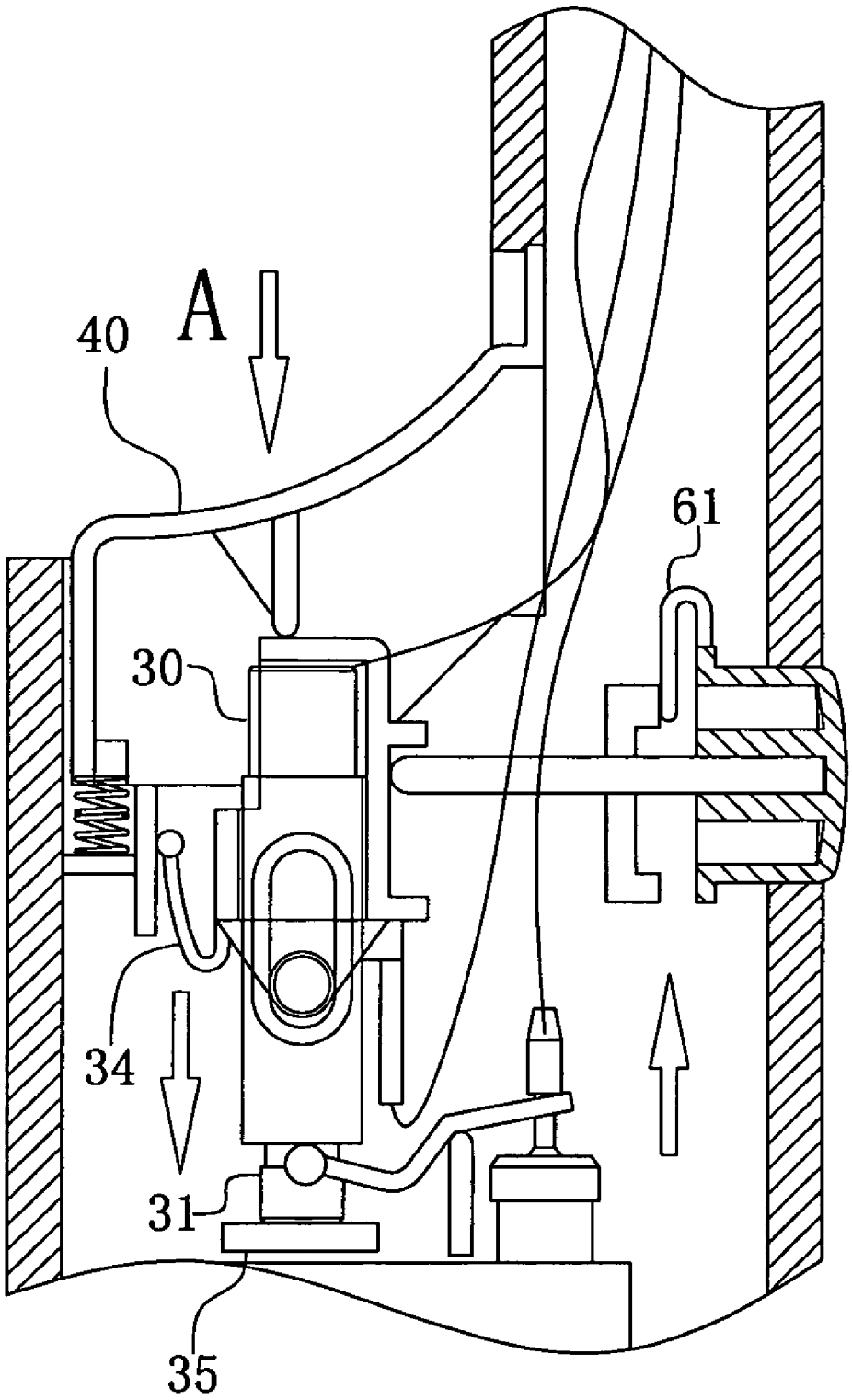

As shown in FIG. 2*c*, if the user pull the trigger 40 along direction A when the piezoelectric unit 30 is at the aligning position thereof, the protrusion 41 pushes the piezoelectric unit 30 to move along direction, too. The starting button 31 then meets a stop 35 formed in the handle 1. As the user keep pulling the trigger 40, the starting button 31 is pressed down by the stop 35, generating sparks for ignition. Meanwhile, the lever 50 is pressed by the piezoelectric unit 30 to open the gas valve 20. The utility lighter of the invention is thus ignited. When the user releases the trigger 40 and the safe button 60, the piezoelectric unit 30 and the safe button 60 resume their constant status as shown in FIG. 2*a* under an urging force from the second and the first elastic elements 34, 61, respectively.

Figure 3A:
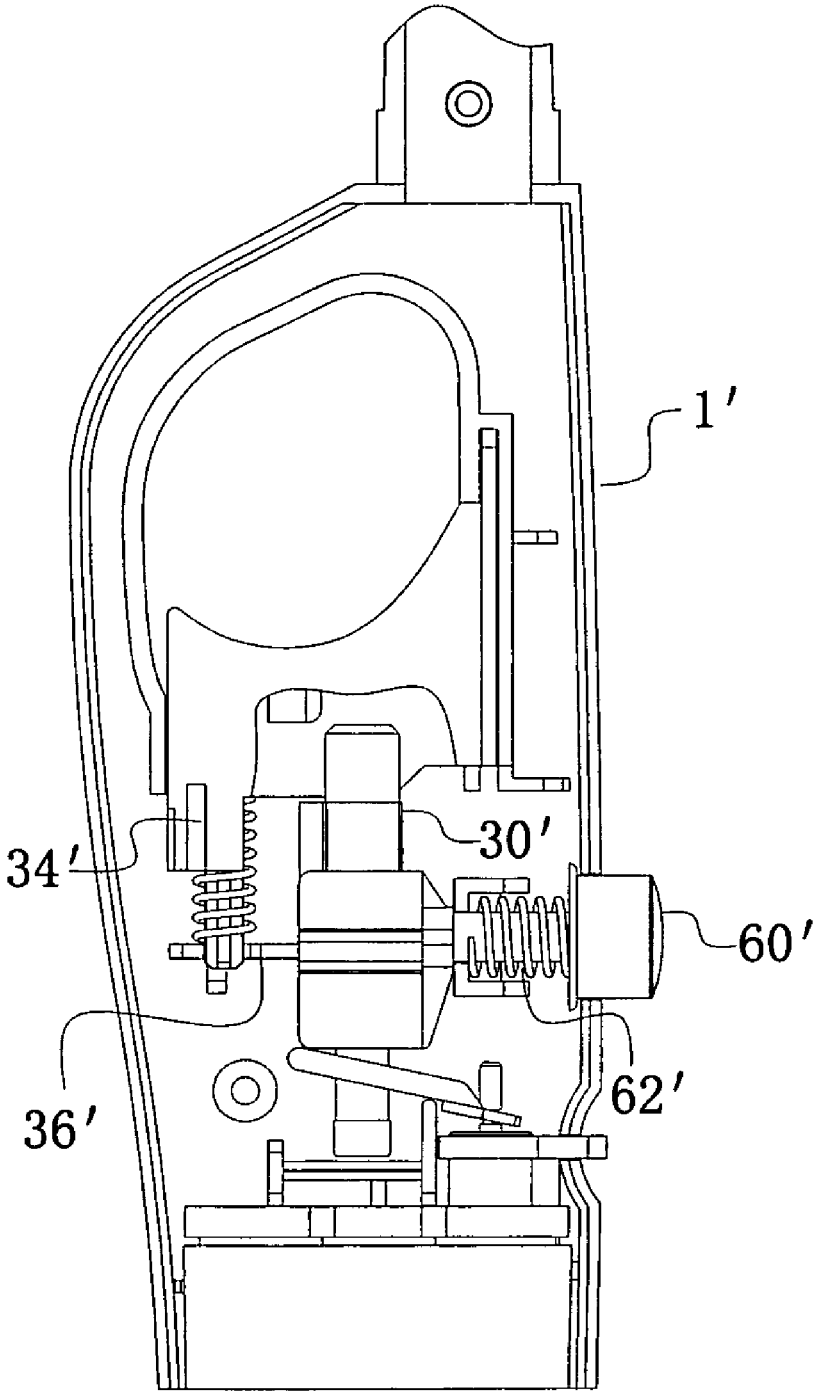
Figure 3B:
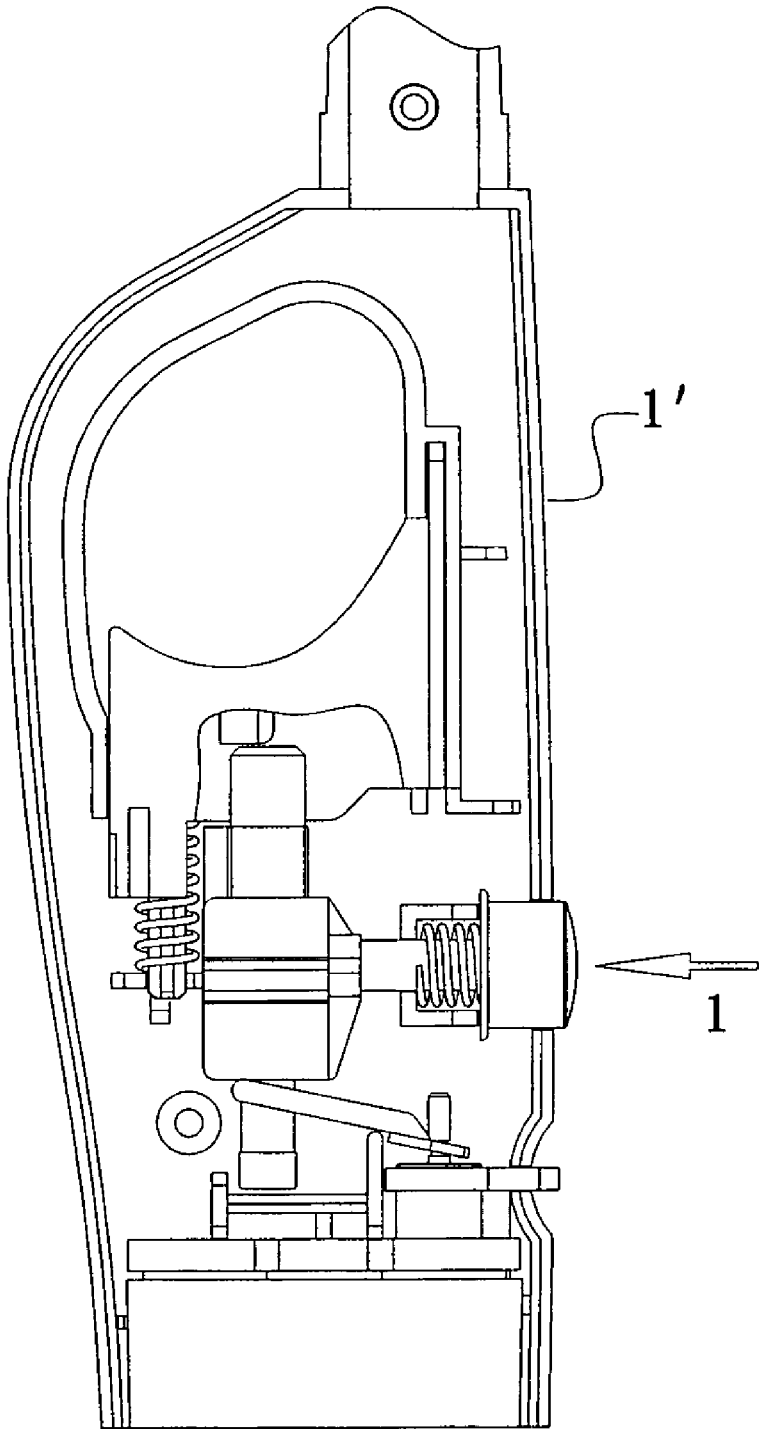
Figure 3C:
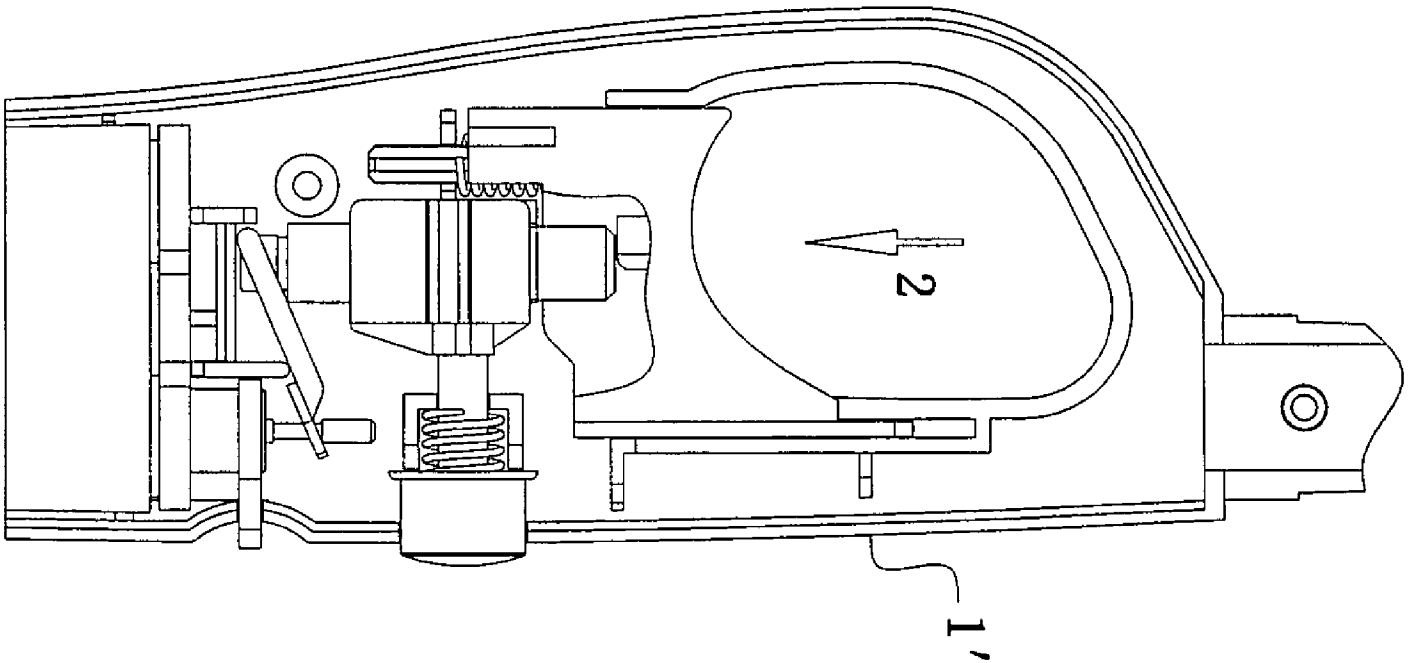

Shown in FIGS. 3*a* to 3*c* is another embodiment of the utility lighter of the invention. In this embodiment, the piezoelectric unit 30' has a horizontal through hole covering a pole 36' formed in the handle 1'. The piezoelectric unit 30' is able to levelly move along the pole 36'. The piezoelectric unit 30' is pushed by a second elastic element 34' onto a finger 62' of a safe button 60'.

The elastic elements as shown in above embodiments are springs. As known by a person in the art, they are also be able to be a piece of an elastic metal or a rubber bar that is able to resume an original position after depressed. Alternatively, the piezoelectric unit 30 or 30' is able to be installed in a seat first. Preferably, there may be provided ultimate limits forming on the handle 1 for the trigger 40 and the safe button 60 so that the trigger 40 and safe button 60 will not be able to be pulled into the handle 1 by overly depression.

It could be seen from above description, before the safe button 60 is depressed, the trigger 40 is able to be pulled over as a conventional utility lighter without any safe means. If the invention is used by a child, it is liable to be thought by him that the utility lighter is out of work or out of gas, thus giving up keeping trying to ignite.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A child resistant utility lighter having a handle, a barrel mounted in said handle and extending outward, a fuel tank within said handle and for containing liquefied gaseous fuel, a gas valve mounted on said fuel tank, a trigger, and, a lever rotatably mounted on said handle by a lever pin, wherein said improvements comprising:

a safe button slidably mounted on said handle and pushed by a first elastic element to an undepressed position; and, a piezoelectric unit contained in said handle and having a starting button, said piezoelectric unit remains in a safe position in which said trigger, when depressed, is unable to make contact with said piezoelectric unit, said piezoelectric unit being placed into an aligning position with the trigger by depressing said safe button, the piezoelectric unit in the aligning position creating a spark for ignition by being contacted by said trigger when said trigger is depressed.

2. The child resistant utility lighter as claimed in claim 1, wherein said trigger has an inner protrusion, which is able to contact said piezoelectric unit when said piezoelectric unit is at said aligning position thereof.

3. The child resistant utility lighter as claimed in claim 1, wherein said safe button has a finger being able to push said piezoelectric unit to said aligning position thereof.

4. The child resistant utility lighter as claimed in claim 2, wherein said safe button has a finger being able to push said piezoelectric unit to said aligning position thereof.

5. The child resistant utility lighter as claimed in claim 1, wherein said piezoelectric unit has a pair of opposite slits respectively containing a pin formed in said handle and is biased toward said safe position by a second elastic element and said safe button, the piezoelectric unit rotating about said pin into said aligning position by operation of the safe button.

6. The child resistant utility lighter as claimed in claim 4, wherein said piezoelectric unit has a pair of opposite slits respectively containing a pin formed in said handle and is biased toward said safe position by a second elastic element and said safe button, the piezoelectric unit rotating about said pin into said aligning position by operation of the safe button.

7. The child resistant utility lighter as claimed in claim 1, wherein said piezoelectric unit has a horizontal through hole covering a pole formed in said handle, the piezoelectric unit sliding on said pole into said aligning position by operation of the safe button.

8. The child resistant utility lighter as claimed in claim 4, wherein said piezoelectric unit has a horizontal through hole covering a pole formed in said handle, the piezoelectric unit sliding on said pole into said aligning position by operation of the safe button.

* * * * *